United States Patent [19]

Smock

[11] Patent Number: 4,491,710

[45] Date of Patent: Jan. 1, 1985

[54] HOUSING ARRANGEMENT FOR A TIMING MECHANISM

[75] Inventor: Steven W. Smock, Indianapolis, Ind.

[73] Assignee: Emhart Industries, Inc., Indianapolis, Ind.

[21] Appl. No.: 551,089

[22] Filed: Nov. 14, 1983

[51] Int. Cl.[3] ..... H01H 43/10; H01H 9/00

[52] U.S. Cl. ..... 200/303; 200/38 R

[58] Field of Search ..... 200/38 R, 38 B, 38 BA, 200/38 C, 38 CA, 303, 293

[56] References Cited

U.S. PATENT DOCUMENTS

| | | | |
|---|---|---|---|
| 3,742,159 | 6/1973 | Brown | 200/38 R |
| 3,754,107 | 8/1973 | Balchunas | 200/38 FB |
| 3,823,280 | 7/1974 | Obermann et al. | 200/38 B |
| 4,045,637 | 8/1977 | Mongean | 200/303 |
| 4,250,420 | 2/1981 | Grah et al. | 200/38 B |
| 4,406,932 | 9/1983 | Voland et al. | 200/38 R |

*Primary Examiner*—John W. Shepperd

*Attorney, Agent, or Firm*—Robert F. Meyer

[57] ABSTRACT

The timing mechanism illustrated in U.S. Pat. Nos. 3,727,015, 3,805,005 and 4,406,932 have been improved by providing cooperating housings for the timing mechanism elements and the motor drive for the timing mechanism such that there is no external wiring between the motor housing and the timing mechanism elements. Means are provided in the motor housing to properly locate the motor and insure proper location between the motor, its associated gear train, and the elements of the timing mechanism.

10 Claims, 4 Drawing Figures

HOUSING ARRANGEMENT FOR A TIMING MECHANISM

BACKGROUND OF THE INVENTION

Generally speaking, the present invention pertains to a combination of a timing mechanism carried in a first housing constructed of an electrically insulative material, a motor and gear train assembly carried in a second housing constructed of an electrically insulative material and holding means maintaining the first and second housings together in a working relationship.

Defrost timing mechanisms or limers have long been used in appliances such as refrigerators to defrost them in accordance with a predetermined program cycle. In the manufacture of these timers, industry is constantly striving to make the timers as small and compact as possible with a minimum number of parts. Also, the industry is highly competitive and, therefore, the most economical fabrication methods are constantly being sought.

Timers which, for the most part, admirably meet these requirements are those discussed and claimed in U.S. Pat. Nos. 3,727,015, 3,805,005 and 4,406,932. As described in U.S. Pat. Nos. 3,727,015 and 3,805,005, there are combination electrical blades and electrical terminals which are held in a housing for the timer through the use of projections lanced from the combination and received in notches provided in the housing wall. And in U.S. Pat. No. 4,406,932 there is presented an improved means to hold the electrical terminals, and blades, as well as the wiring to the terminals. The present invention represents an improvement over these types of structures.

OBJECTS OR FEATURES OF THE INVENTION

It is, therefore, a feature of the present invention to provide a timer which is simple and economical to produce. Another feature of the invention is to provide such a timer having cooperating individual housings for the timer itself and the motor drive which are held in a working relation such that motor lead wires are not exposed to the environment. Another feature of the invention is to provide such a timer wherein the housings are held together by snap fingers. Still another feature of the invention is to provide such a timer wherein the motor housing include a cavity to carry the motor and means to locate the motor and a gear train associated with the motor. Yet another feature of the invention is the provision of electrical buss bars connecting the motor input to electrical terminals of the timer. These and other features of the invention will become apparent from the following description taken in conjunction with the accompanying drawings.

DETAILED DESCRIPTION OF THE INVENTION

The timer 10 utilizing the concepts of the present invention is completely described in the aforementioned U.S. patents and, therefore, in the interest of simplicity, its complete description will not be presented.

Figure 1:
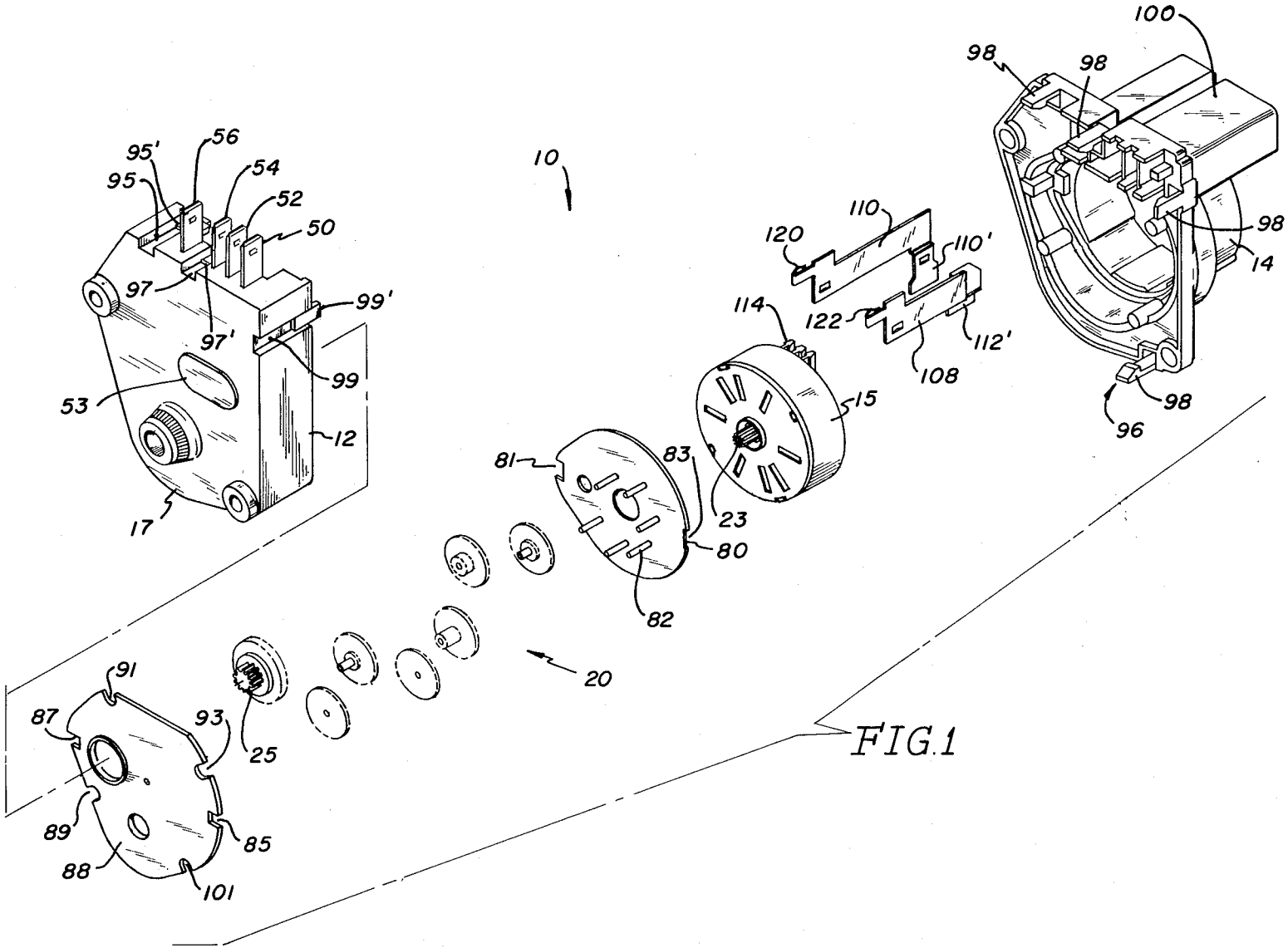
FIG. 1 is an exploded view of a timer employing the features of the invention.
Figure 2:
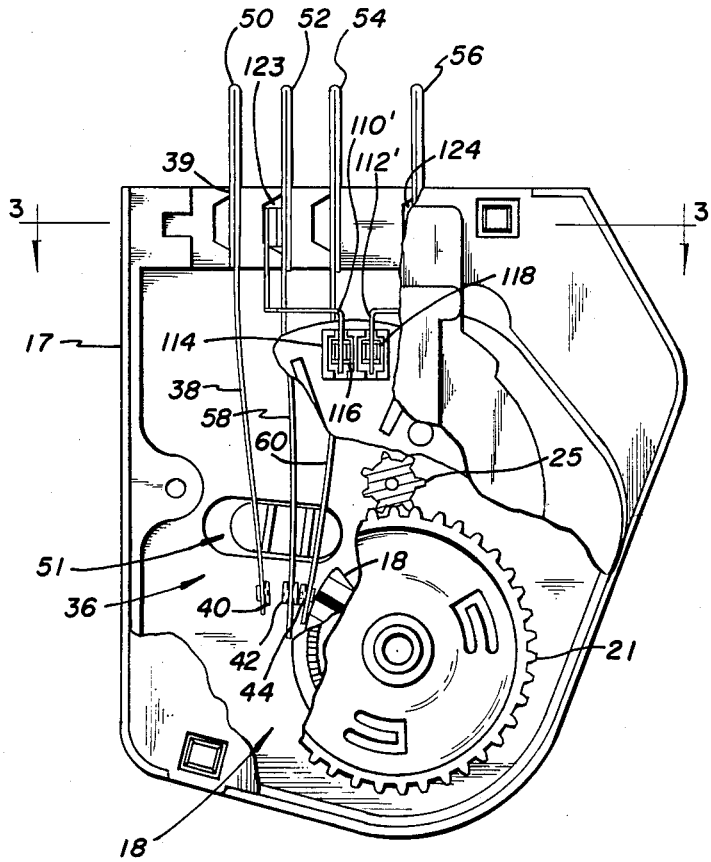
FIG. 2 is a front view of the timer with portions thereof being removed to show the various elements of the timer.

Referring to FIGS. 1 and 2, the various elements of timer 10 are enclosed in a housing 12, the housing being formed from a plastic cup-shaped member 17. A constant speed motor 15 is carried in housing 14 fabricated from a plastic material, the motor being used to drive a cam programming means 18 through a gear train 20 which is also carried in housing 14, and a gear and ratchet clutch 21. Clutch 21 permits cam programming means 18 to be manually set. Switch means 36 which includes a plurality of switch blades carried in slots 39, is responsive to cam programming means 18. Switch blades 38, 58 and 60 carry electrical contacts 40, 42 and 44 such that when the contacts are brought together in a predetermined sequence, an electrical circuit can be completed through the blades to electrical terminals 50, 52, 54 and 56. The blades are separated by a slidable separating means 51 which is mounted in a suitable cavity 53 molded in the housing 17. As more completely described in the referenced patents, rotation of cam programming means 18 causes the contacts 40, 42 and 44 to be engaged in a predetermined programmed sequence.

Figure 3:
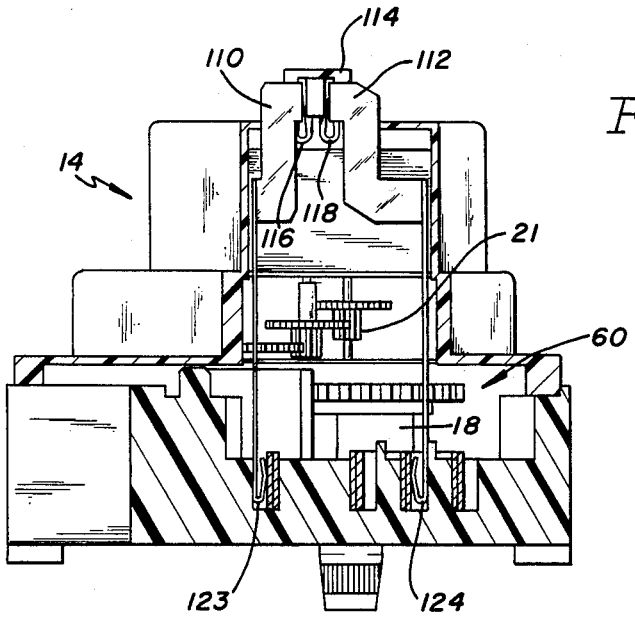
FIG. 3 is a section taken along the line 3—3 of FIG. 2.
Figure 4:
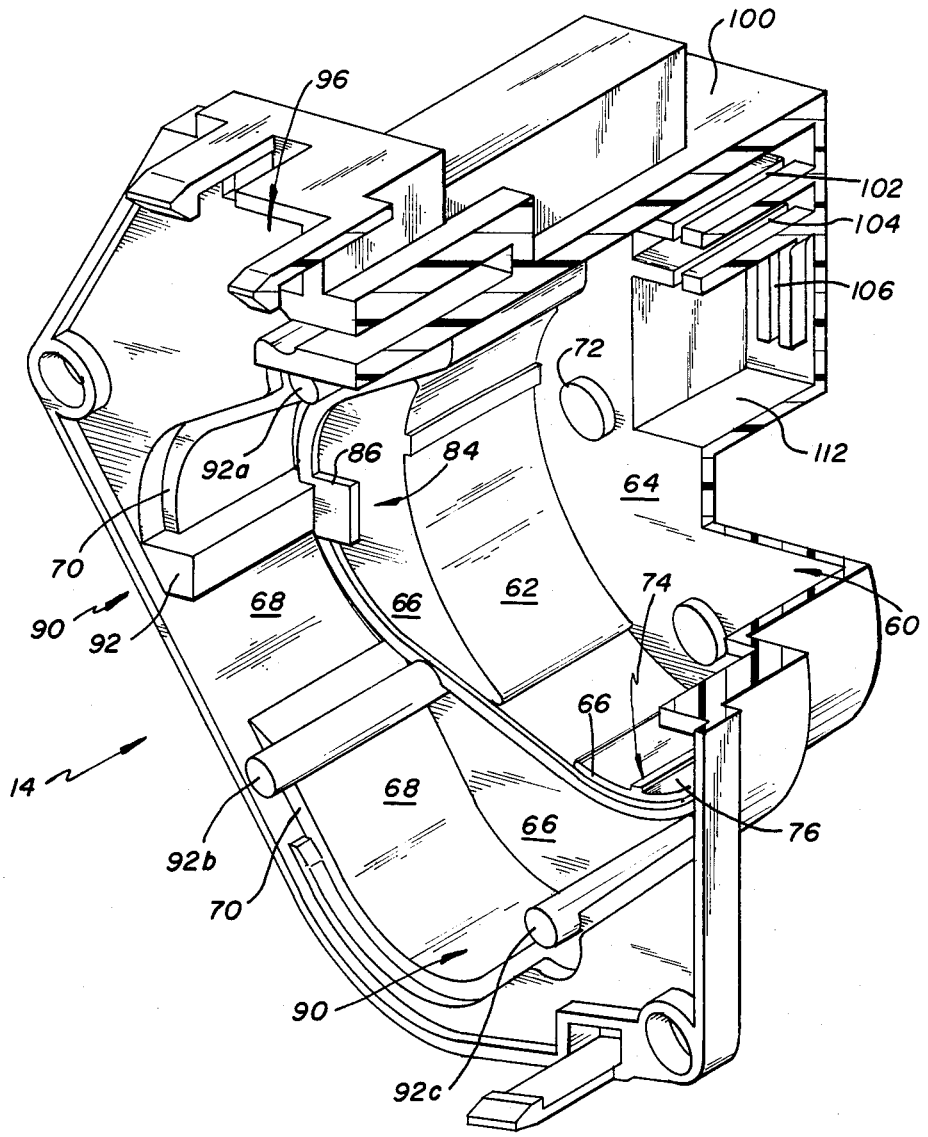
FIG. 4 is an enlarged isometric view of a housing for the motor drive of the timer.

Referring to FIGS. 3 and 4, in accordance with the present invention, housings 12 and 14 are arranged and constructed such that the timer elements and the motor drive are held in working relation to each other within the housings to provide a neat and compact package. In addition the starting and stopping of the motor can be controlled by the cam and switch means of the timer elements without the use of extraneous wires.

Motor housing 14 includes an open cavity 60 having sidewalls 62 and a base 64 for receiving motor 15. A ledge 66 extends outwardly from the sidewalls 62 to sidewalls 68. Another ledge 70 extends from sidewalls 68. A plurality of pads 72 extends from base 64 upon which the motor is seated. A guide means 74 insures that the motor is centered within cavity 60. Guide means 74 includes a plurality of ribs 76 disposed at intervals around and extending lengthwise along sidewalls 62.

Ledge 66 carries arbor plate 80 (FIG. 1) which carries posts 82 which carry the gear and pinions of gear train 20. Another guide means 84 insures that the arbor plate be properly located. Guide means 84 includes oppositely disposed studs 86 (only one shown) which engage slots 81 and 83 of the arbor plate.

Ledge 70 carries cover plate 88 (FIG. 1) of the gear train. Guide means 90 insures that the cover plate will be properly located. Guide means 90 includes a plurality of ribs or posts 92 extending inwardly from sidewalls 68 and engage slots 85, 87, 89, 91, 93 and 101 of the cover plate. In addition, posts 92*a*, 92*b* and 92*c* serve to hold the cover plate, and thus the whole assembly, in place by heat staking their end surfaces over the cover plate.

With this cavity arrangement in combination with the various guide means, exact alignment between the gears and pinions of the gear train, the output pinion 23 of the motor with the gear train, as well as the output pinion 25 (FIGS. 1 and 2) of the gear train with gear and ratchet 21 is readily achieved. Such alignment is critical to avoid binding between the various timer, gear train and motor elements.

Referring to FIG. 1, after assembly, housings 12 and 14 are held together in working relation to each other through holding means 96. Holding means 96 includes a plurality of spring slips 98 carried by housing 14 which are sprung over the walls of housing 12 and tightly held in slots 95, 97 and 99 of housing 12 and spring clipped over tabs 95', 97' and 99' carried in the slots.

There is also provided a means to electrically connect motor 15 to one of the electrical terminals 50, 52, or 54 and 56 without the use of wires running outisde the timer and motor housings. Referring to FIGS. 1 and 4, there is shown a terminal housing 100 constructed as an integral part of housing 14. As shown, there are slots 102, 104 and 106, and another slot similar to and adjacent 106, but not shown, for receiving electrical buss bars 108 and 110. As more clearly shown in FIGS. 2 and 4, slot 106 and the slot adjacent to it are provided in a cavity 112 which receives a terminal block 114 carried by motor 15 and having spring clips 116 and 118 for receiving tabs 110' and 112' of the buss bars. The other ends of buss bars 110 and 112 carry barbs 120 and 122 (FIG. 1) which when inserted into slots 123 and 124 provide an electrical connection with terminals 52 and 56. Terminal 52 and 56 are then plugged into an external power source such as a refrigerator power source.

What is claimed is:

1. In combination, a timing mechanism carried in a first housing constructed of an electrically insulative material, a motor and gear train assembly carried in a second housing constructed of an electrically insulative material, and holding means maintaining said first and second housings together in a working relationship wherein said second housing includes a cavity having first sidewalls and a base receiving said motor and having a second cavity receiving a terminal block carried by said motor, a first ledge extending outwardly from a portion of said first sidewall receiving an arbor plate of said gear train assembly, and second sidewalls extending from said first ledge providing a second ledge receiving a cover plate of said gear train assembly.

2. The combination according to claim 1 wherein said holding means includes a plurality of snap fingers extending from one of said first and second housings and engaging the other of said first and second housings.

3. The combination according to claim 1 further including first guide means carried by said first sidewalls guiding said motor into place.

4. The combination according to claim 3 wherein said first guide means includes ribs extending along said first sidewalls.

5. The combination according to claim 1 further including second guide means carried by said first ledge guiding said arbor plate in place.

6. The combination according to claim 5 wherein said second guide means includes studs extending from said first ledge.

7. The combination according to claim 1 further including third guide means carried by said second ledge guiding said cover plate of said gear train assembly in place.

8. The combination according to claim 7 wherein said third guide means includes ribs extending from said second sidewalls.

9. The combination according to claim 1 further including a plurality of pads extending from said base for seating said motor above said base.

10. The combination according to claim 1 further including a terminal housing integrally constructed with said second housing including slots exposed to said motor and receiving electrical buss bars electrically coupling said motor and electrical terminals of said timing mechanism.

* * * * *